US005368233A

United States Patent [19]

Brusko

[11] Patent Number: 5,368,233

[45] Date of Patent: Nov. 29, 1994

[54] SPRAY DISK FOR CLOSE CENTERLINE SPACING

[75] Inventor: Paul Brusko, Flowery Branch, Ga.

[73] Assignee: Nordson Corporation, Westlake, Ohio

[21] Appl. No.: 115,885

[22] Filed: Sep. 1, 1993

[51] Int. Cl.[5] ..... B05B 1/34

[52] U.S. Cl. ..... 239/290; 239/424.5; 239/550; 239/566

[58] Field of Search ..... 239/424.5, 600, 548, 239/290, 550, 299, 423, 296, 424, 298, 416.5, 566, 417.5, 552

[56] References Cited

U.S. PATENT DOCUMENTS

| | | | |
|---|---|---|---|
| Re. 33,481 | 12/1990 | Ziecker et al. . | |
| 3,053,461 | 9/1962 | Inglis . | |
| 4,026,440 | 5/1977 | Crum et al. . | |
| 4,553,701 | 11/1985 | Rehman et al. . | |
| 4,645,127 | 2/1987 | Emory et al. | 239/424.5 X |
| 4,785,996 | 11/1988 | Ziecker et al. | 239/600 X |
| 4,801,051 | 1/1989 | Lewis et al. . | |
| 4,815,660 | 3/1989 | Boger . | |
| 4,891,249 | 1/1990 | McIntyre . | |
| 4,907,741 | 3/1990 | McIntyre . | |
| 4,967,956 | 11/1990 | Mansfield | 239/424.5 X |
| 4,969,602 | 11/1990 | Scholl . | |
| 4,983,109 | 1/1991 | Miller et al. . | |
| 5,016,812 | 5/1991 | Pedigrew . | |
| 5,065,943 | 11/1991 | Boger et al. . | |
| 5,169,071 | 12/1992 | Boger et al. | 239/600 X |
| 5,194,115 | 3/1993 | Ramspeck et al. . | |

*Primary Examiner*—Andres Kashnikow
*Assistant Examiner*—Kevin P. Weldon
*Attorney, Agent, or Firm*—Wood, Herron & Evans

[57] ABSTRACT

A nozzle for a hot melt adhesive spray head which mounts directly to a nozzle mounting surface. To permit a series of spray nozzles to be mounted closely together, the nozzle has a threaded stud integral with and extending from the rear side of the nozzle. The adhesive passage in the nozzle mounting surface has a threaded bore for receiving the threaded stud of the nozzle. The nozzle includes a first O-ring seal to prevent the pressurized pattern air from leaking between the nozzle and the nozzle mounting surface. A second O-ring seal isolates the hot melt adhesive from the pressurized patten air at the interface between the nozzle and the nozzle mounting surface.

17 Claims, 4 Drawing Sheets

SPRAY DISK FOR CLOSE CENTERLINE SPACING

BACKGROUND OF THE INVENTION

The present invention relates generally to the area of fluid spraying and dispensing and more particularly to a nozzle construction for dispensing a spiral pattern of elongated strands of a heated hot melt adhesive onto a surface of a substrate.

Hot melt thermal plastic adhesives have been widely used in industry for adhering many types of products and are particularly useful in applications where quick setting time is advantageous. Further, bonding materials such as chopped fibers or fluff-type material forming a non-woven layer presents additional problems in dispensing the adhesive so that only the surface of the non-woven layer is bonded. Further, the adhesive must be sufficiently thinly applied so that its presence is not apparent on the opposite side of the substrate to which the non-woven material is being bonded such as a polyurethane sheet. In order to create elongated thin beads of adhesive, the dispensing nozzle has a plurality of air jets connected to a common air manifold which in turn is connected to a source of pressurized air. The air jets are arranged in the nozzle such that they tangentially contact the bead of adhesive as it is dispensed from the nozzle. The force of the air jets is effective to stretch and rotate the dispensed adhesive bead such that it is applied in a relatively compact spiral pattern on the substrate.

Depending on the application, it is also desirable to change the diameter of the adhesive bead being dispensed from the nozzle. Consequently, preferably the nozzles are exchangeable without requiring a different manifold, nozzle mounting plate or disassembly of the spray head. These problems are addressed by the nozzle disclosed in U.S. Pat. No. Re. 33,481 issued on Dec. 11, 1990 to R. A. Ziecker et al. which is assigned to the same assignee as this invention.

The nozzle disclosed in the '481 patent is adapted to mount to a threaded extension of a standard adhesive spray head, or spray gun. An adhesive discharge opening in the threaded extension is connected to an adhesive passage in the spray head body, and an air discharge opening in the threaded extension is connected to an air passageway in the spray head body. The nozzle has a spray disk which has a boss extending outwardly from a first, rear surface of the spray disk and a nozzle tip extending outwardly from a second, front surface of the spray disk. When the nozzle is mounted to the threaded extension, a through bore extending through the spray disk, boss and nozzle tip communicates with the adhesive discharge opening in the threaded extension of the spray head body. Heated hot melt adhesive is transmitted from the adhesive passage in the spray head body, through the adhesive discharge opening in the threaded extension and then into the through bore in the nozzle. The adhesive is ejected as an extruded bead through the nozzle tip toward a substrate.

The nozzle of the '481 patent is formed with an annular notch or groove which extends from its rear surface having the boss toward the front surface formed with the nozzle tip, and is located radially outwardly from the through bore in the nozzle. The annular groove is provided to assist in drilling bores in the spray disk through which jets of pressurized air are directed at an angle of about 30 degrees, and substantially tangent to, the adhesive bead ejected from the nozzle tip. While the nozzle disclosed in the '481 patent facilitates accurate drilling of the air jet bores and produces an acceptable spiral pattern of a strand or fiber of adhesive, some deficiencies have been discovered in certain applications. The nozzle is mounted to the threaded extension by a threaded mounting nut, and it has been found that the mounting nut can be over-torqued when the nozzle is installed. Such over-torquing of the mounting nut urges the periphery of the spray disk against the threaded extension of the spray head with such force that the spray disk can deflect or distort thus creating a leakage path at the interface between the nozzle boss and the threaded extension. In some instances, it has been found that hot melt adhesive has flowed radially outwardly along this leakage path into the annular groove where the pressurized air enters the air jet bores in the spray disk. This can clog the air jet bores and thus restrict the flow of air necessary to attenuate or stretch the adhesive bead to form an elongated adhesive fiber.

In addition to overtightening of the nozzle, another problem can occur during the assembly operation. Because the nozzle and mounting nut are separate pieces, the operator must properly orient the nozzle relative to the threaded extension of the spray head body before securing it with the mounting nut. Occasionally, the nozzle is installed upside down, i.e., with the nozzle tip facing the threaded extension and the boss facing outwardly, which ruins the nozzle tip and requires replacement of both the threaded extension and the nozzle.

Another potential problem with the nozzle disclosed in the '481 patent is that the front surface of the nozzle spray disk from which the nozzle tip extends is not mounted flush with the rim of the mounting nut which secures the nozzle to the threaded extension of the spray head body. As a result, a cavity or space is formed between the nozzle tip and the rim of the nut. Particularly when the dispenser is operated intermittently, it has been found that cut-off drool, i.e., adhesive remaining after the spray head is shut off, can collect in the space or cavity between the nozzle tip and the mounting nut. This cut-off drool can collect and clog the air jet bores formed in the nozzle, thus inhibiting the formation of an elongated adhesive fiber. In addition, a collection of adhesive fibers within such cavity is difficult to clean.

The potential problems with the nozzle disclosed in the '481 patent have been addressed in a one-piece nozzle cap manufactured and sold by Nordson Corporation of Amherst, Ohio, the assignee of this invention. The nozzle cap is formed from a section of hex-shaped bar stock such that the mounting nut and nozzle are integrally formed in a single, unitary construction instead of two separate pieces as in the '481 patent. A bore is drilled and tapped in the hex stock to form the mounting nut portion of the nozzle cap, and the nozzle is formed where such bore terminates. A first side, or rear surface, of the nozzle spray disk is thus located within the interior of the mounting nut portion of the nozzle cap, and the opposite, second side, or front surface, of the nozzle spray disk is flush with the end of the mounting nut portion so that there is no rim or cavity between the nozzle and mounting nut as in the '481 patent described above.

The one-piece nozzle cap therefore eliminates the collection of adhesive at the outer surface of the nozzle, and prevents installation of the nozzle upside down, which are potential problems with the nozzle disclosed in the '481 patent. Nevertheless, a number of difficulties are presented in the installation and fabrication of this one-piece nozzle cap. Although formed in one piece, the nozzle cap can be overtightened on the threaded extension of the dispensing device wherein the mounting nut portion is over-torqued causing the nozzle spray disk and boss to deflect or distort against the threaded extension of the spray head. This can create the same type of leakage problems between the through bore in the nozzle and the air jet bores therein described above in connection with the '481 patent.

The above problems are addressed with the construction described in U.S. Pat. No. 5,065,943 issued on Nov. 19, 1991 to B. Boger et al. which is assigned to the same assignee as this invention. In the preferred embodiment, the nozzle cap comprises a mounting piece, or nut, permanently mounted to a nozzle formed with a stepped through bore and a plurality of spaced air jet bores located radially outwardly from the through bore. Both the mounting piece and nozzle are machined separately, and then are substantially permanently interconnected by roll-forming an end of the nut flush with the peripheral edge of the nozzle. When the mounting piece the nozzle cap is assembled on the threaded extension of the adhesive dispensing device, the nozzle is positioned such that its stepped through bore communicates with the adhesive passage in the threaded extension and its air jet bores communicate with the air passageway in the nozzle. An adhesive bead is extruded through the stepped through bore in the nozzle, and this bead is impacted by air jets from the spaced air jet bores which stretch or attenuate the adhesive bead to form an elongated adhesive fiber for deposition in a controlled spiral spray pattern onto a substrate.

One aspect of this invention is therefore predicated on the concept of forming a two-piece nozzle cap in which each piece is separately machined, and then the two pieces are substantially permanently connected to one another. This avoids the installation problems of the type discussed above in connection with the '481 patent, reduces the difficulty and cost of the machining operations and results in less scrap.

With respect to the problem of adhesive leakage described above, the nozzle of the nozzle cap is preferably formed with a seat at the adhesive inlet to its stepped through bore. This seat mounts an O-ring substantially concentric to the stepped through bore, and in a position between the stepped through bore and the air jet bores formed in the nozzle spray disk thereby providing a fluid tight seal between the adhesive and the air jet bores. In addition, the O-ring in combination with a three-stage assembly sequence reduces the potential for overtightening of the nozzle cap during installation.

While the performance and reliability of the above nozzle cap is better than earlier designs, utilization of the interchangeable nozzle requires the manufacture and assembly of a complex nozzle cap comprised of the nozzle and mounting piece. In addition, the nozzle cap mounts on a threaded extension which is an additional component required to mechanically couple the interchangeable nozzle to the two-way valve or distribution plate of the spray head. The mounting piece, or mounting nut, and threaded extension add significant costs to the manufacture and assembly of the spray head. In addition, the threaded extension and mounting nut limit the centerline spacing of the nozzles as will be described.

In most applications, it is desirable to deposit a series or grouping of identical spiral patterns of elongated strands onto a predetermined area of a surface of a substrate. In such applications, the dispensing nozzles are mounted onto threaded extensions which in turn are mounted on the two-way valves or directly on a distribution plate on which the two-way valves are mounted. For example, as described in U.S. Pat. No. 4,815,660 issued on Mar. 28, 1989 to B. Boger, two-way valves which are attached to the manifold surface such that an adhesive passage is provided to each of the two-way valves which controls the flow of adhesive to the nozzle. Nozzles are attached to the two-way valves by a mounting nut which secures the nozzle to a threaded extension extending from an end of each of the two-way valves. The nozzles may be placed in a single row; however, there must be sufficient space between the mounting nuts to permit a wrench or other tool to engage the nut. Therefore, the width of the mounting nut determines the minimum nozzle centerline spacing which, in turn, determines the minimum width of the spiral pattern so that the spiral patterns can maintain the preferred tangential relationship to each other.

In some applications, it is desired that the width of the spiral pattern be less than that permitted by the single row arrangement of the nozzles. Therefore, as described in U.S. Pat. No. 4,983,109, issued on Jan. 8, 1991 to S. Miller, et al., the nozzles may be arranged in two rows with the second row of nozzles having nozzle centerlines located midway between the nozzle centerlines of the first row. That arrangement permits the width of the spiral pattern to be one half of the minimum width available when the nozzles are arranged in a single row.

The two row, staggered nozzle arrangement is implemented with a distribution plate which ports the hot melt adhesive and pressurized air to the two-way valves and from the valves to the threaded extensions mounted on the distribution plate in the two-row staggered pattern. Alternatively, a special adapter plate which has an arrangement of threaded extensions conforming to the desired two row, staggered nozzle pattern is connected to the discharge surface of the distribution plate. The hot melt adhesive passages and air passageways passing through the adapter plate and each of the threaded extensions are in two rows and are in closer proximity than with a single row nozzle arrangement. Therefore, it may not be possible to supply the pressurized air in the preferred orientation with respect to the air passageways in the nozzle.

In typical applications, the substrate on which the adhesive is to be deposited is moving linearly past the two rows of staggered nozzles. Consequently, a selected area on the substrate surface passes beneath each row at a different time. Therefore, in order for the two rows of nozzles to dispense adhesive on the same area, the two-way valves associated with one row of nozzles must be fired at a slightly different time than the two-way valves associated with the second row of nozzles. This timing requirement adds substantial complexity to the valve control mechanism.

Therefore, using a two row, staggered nozzle pattern to accommodate a narrower width of the spiral pattern has the disadvantages of generally requiring an additional expensive adapter plate, and a more complex and expensive two-way valve control mechanism.

SUMMARY OF THE INVENTION

To overcome the disadvantages described above, the present invention provides a threaded shaft integral with and extending from the rear side of the nozzle spray disk for attaching the nozzle directly to a distribution plate. The present invention eliminates the mounting nut and the threaded extension; and therefore the invention is particularly suited for close single row nozzle centerline spacing and is especially useful in those applications where a smaller width spray pattern is required.

According to the principles of the present invention, and in accordance with the described embodiments, a nozzle for spraying a hot melt adhesive in a predetermined pattern of elongated strands includes a spray disk with a centrally located adhesive passage extending therethrough and a plurality of air passageways surrounding the adhesive passage. A threaded shaft is integral with and extends from the rear surface of the spray disk, or spray plate, and threadedly engages an adhesive passage located on a nozzle mounting surface of a distribution plate, or distribution manifold, on the spray head. An O-ring seal is located between the rear surface of the spray disk and the nozzle mounting surface and encompasses the plurality of air passageways so that pressurized air is prevented from leaking to atmosphere. A second O-ring is located between the threaded shaft and the adhesive passage in the distribution plate to provide a seal between the hot melt adhesive and the pressurized air.

In one embodiment, the hot melt adhesive and pressurized air are directed to separate cavities on the nozzle mounting surface which communicate with the adhesive passage and plurality of air passageways in the nozzle. In an alternative embodiment, the hot melt adhesive and pressurized air are both ported into a single cavity on the nozzle mounting surface. The O-ring and the other mechanical interfaces between the nozzle and the distribution plate separate the adhesive from the pressurized air. This alternative design reduces machining of the nozzle mounting surface and therefore reduces cost.

The constructions of the present invention secures the nozzle to the spray head without requiring a mounting nut or threaded extension. Consequently, the nozzles may be mounted in a single row adjacent to each other as close as machining tolerances will allow. Therefore, the width of the spiral pattern may be reduced and is limited only by the construction of the nozzle and not by how the nozzle is mounted to the spray head. The closer centerline spacing of the nozzles permitted by the present invention, eliminates, in many applications, the necessity of a two row, staggered nozzle arrangement.

The constructions of the present invention have the advantage of mounting the nozzles directly on a flat planar nozzle mounting surface on the distribution plate of the spray head which permits the closest possible spacing of the nozzles in a single row. Without the mounting nut, there are no corners, joints or surfaces forward of the spray disk in which extraneous adhesive can collect. In addition, the forward surface of the spray disk is completely exposed for easy cleaning. The O-ring seal which prevents air from leaking to atmosphere compresses as the nozzle is threadedly engaged into the spray head and the rear surface of the spray disk contacts the nozzle mounting surface without deforming the spray plate or any other part of the nozzle. The nozzle construction provides a further advantage in that without the intervening adapter plate and threaded extension, there is more flexibility in how and where the adhesive passages and air passage ways are ported to each nozzle location on the nozzle mounting surface.

The above constructions of the present invention have additional advantages of improving performance, reducing the number of parts, reducing manufacturing costs and reducing maintenance of the spray head. These and other objects and advantages of the present invention will become more readily apparent during the following detailed description together with the drawings herein.

DETAILED DESCRIPTION OF THE INVENTION

Figure 1:
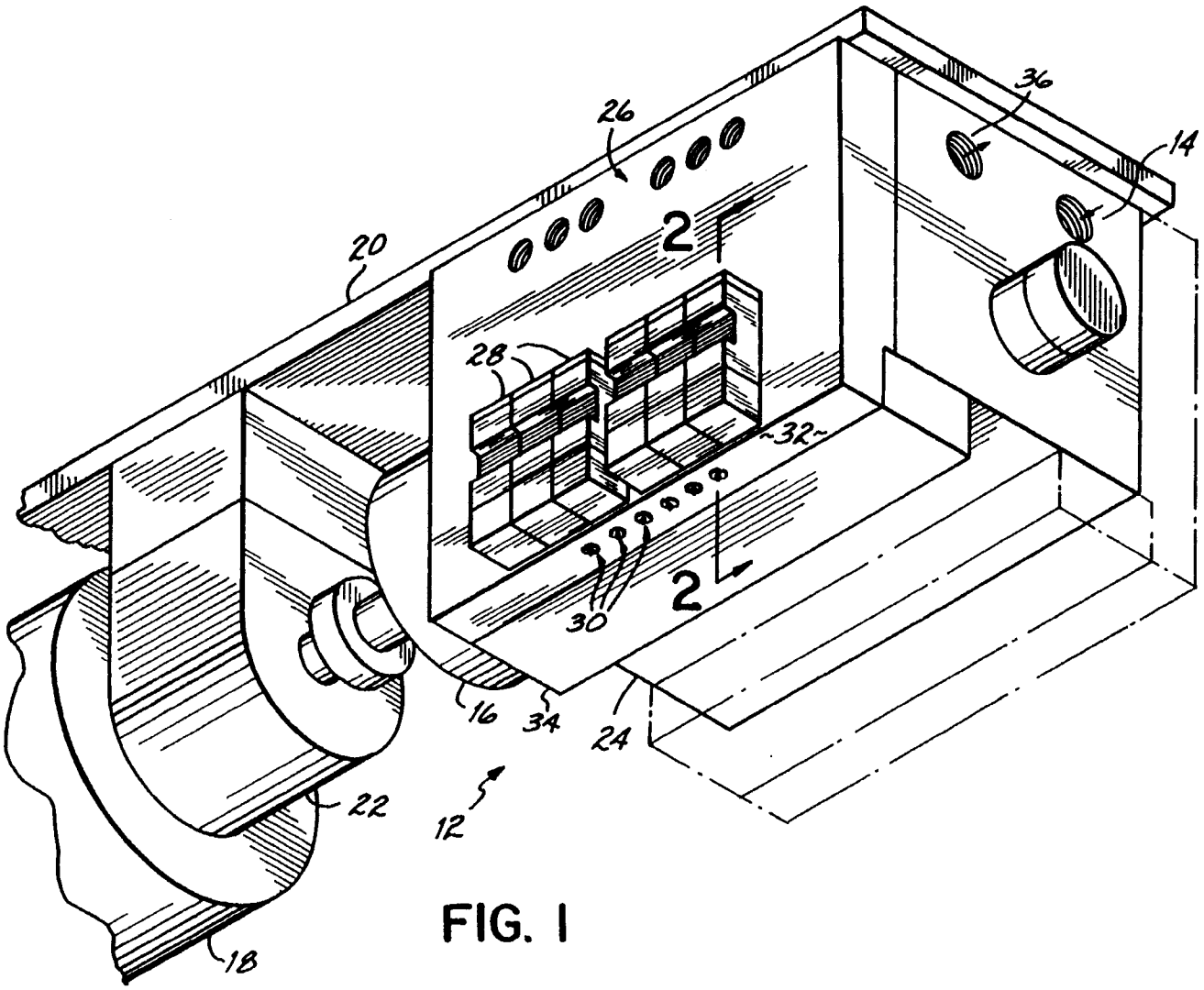
FIG. 1 is a bottom perspective view of a spray head illustrating the general system components in which the present invention is utilized.

FIG. 1 illustrates a spray head 12 used in a hot melt adhesive dispensing system. A supply of heated hot melt adhesive is connected to a supply port 14 on the spray head 12. The supply port 14 provides a source of heated hot melt adhesive to a pump 16. The pump is driven by a motor 18 fastened to a mounting plate 20. The motor is connected to a speed reduction assembly 22 the output of which is coupled to the pump 16. The pump 16 provides precise quantities of hot melt adhesive to individual adhesive supply passages within a central manifold 24 connected to the mounting plate 20. The manifold 24 supplies the metered quantities of hot melt adhesive to individual adhesive passages within a distribution plate 26. Each of the adhesive passages conducts through a two-way flow control valve 28 and then back into the distribution plate 26. The hot melt adhesive is then discharged from the spray head 12 through nozzles 30 which are mounted on a flat planar nozzle mounting surface 32 of the distribution plate 26. An air manifold 34 is connected to the central manifold 24 and distribution plate 26 and provides a source of pattern air, or fiberizing air, which is discharged by the nozzles 30 to manipulate the dispensed bead of heated hot melt adhesive from the nozzle 30 into a desired predetermined pattern, for example, a spiral pattern. The adhesive dispensing system provides relative motion between the spray head and the substrate, or material, on which the heated hot melt adhesive is to be dispensed. The heated hot melt adhesive is dispensed in a predetermined pattern onto selected areas of the substrate by coordinating operation of the two-way valves with the relative motion between the spray head and substrate. Heated hot melt adhesive that is received through the supply port 14 but is not dispensed through the nozzles 30 is recirculated back to the hot melt supply through return port 36.

Figure 2:
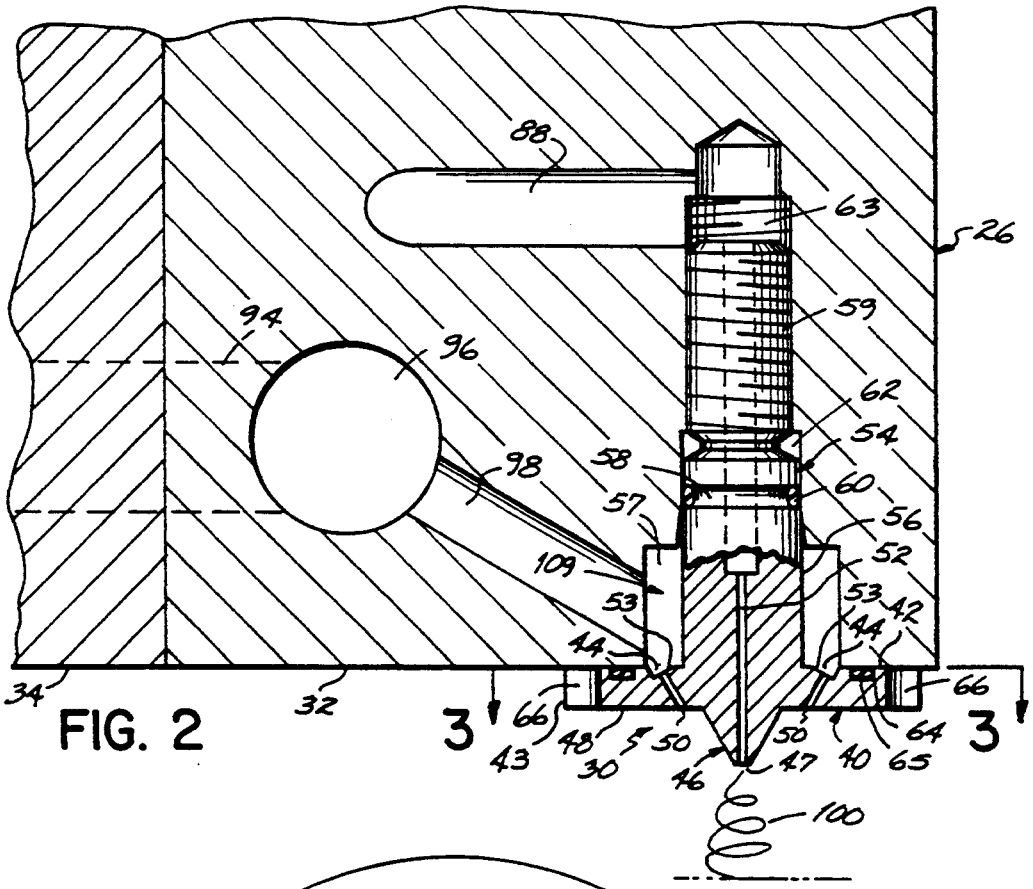
FIG. 2 is an enlarged cross-sectional view taken along line 2—2 of FIG. 1 and illustrates the nozzle of the present invention.
Figure 3:
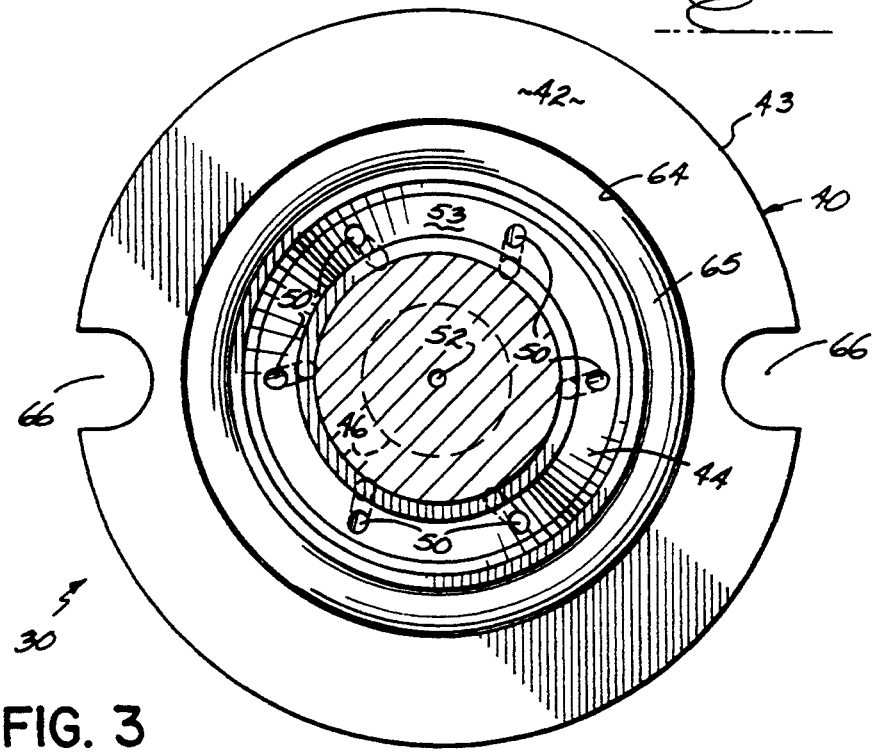
FIG. 3 is a cross-sectional view taken along lines 3—3 of FIG. 2 and illustrates the rear of the nozzle.

FIG. 2 is a cross sectional view of the nozzle 30 assembled in the distribution plate 26, and FIG. 3 is a view illustrating the back of the nozzle. Referring to FIGS. 2 and 3, the nozzle 30 is comprised of a spray disk, or spray plate, 40 having a first side with a rear surface 42 in which is formed an annular air groove 44. A nozzle tip 46 having an adhesive orifice 47 on an outer end extends outwardly from a front surface 48 on an opposite second side of the spray disk 40. A nozzle adhesive passage 52 carrying heated hot melt adhesive extends centrally through the spray disk 40 and nozzle tip 46 and terminates at the adhesive orifice 47 from which the bead of hot melt adhesive is dispensed. The nozzle adhesive passage 52 through the nozzle tip has a diameter in the range of from approximately 0.012 inches (0.305 mm) to 0.030 inches (0.762 mm). A plurality, for example, six, air passageways or air jet bores 50 having a diameter of approximately 0.030 inches (0.762 mm) extend between the annular air groove 44 and the front surface 48 of the spray disk 40. The plurality of air jet bores 50 are oriented at an angle of approximately 30 degrees to the center longitudinal axis of the adhesive passage 52 and direct a pressurized stream of air to tangentially intersect the dispensed bead of hot melt adhesive. The annular air groove 44 is V-shaped with a pair of side walls approximately perpendicular to each other. The side wall 53 contiguous with the air jet bores 50 is formed at approximately a 30 degrees with the rear surface 42 of the spray disk 40.

A shaft 54 is centrally located on the spray disk 40 and has are end therewith. The shaft 54 integral extends outwardly from and substantially perpendicular to the rear surface 42. The nozzle adhesive passage 52 also extends centrally through the shaft 54. The shaft 54 has a first extension segment 56 at one end which is located adjacent to the rear surface 42 and extends through an air chamber 57 contiguous with the nozzle mounting surface 32. An O-ring groove 58 is located between the first extension segment 56 and thread 59 on an opposite end of the shaft 54. An O-ring 60 located in the O-ring groove 58 in sealing contact with the shaft 54 and the annular side wall of a sealing bore 62 intersecting the air chamber 57. The O-ring functions to seal the hot melt adhesive from the pressurized air in the air chamber 57. The threaded end 59 of the shaft 54 engages a cylindrical threaded nozzle mounting bore 63 thereby securing, or coupling the nozzle 30 to the distribution plate 26 of the spray head 12.

The rear surface 42 of the spray disk 40 also has an annular O-ring groove 64 which encompasses or surrounds the annular air groove 44 and the plurality of air jet bores 50. The O-ring groove is located on the rear surface 42 between the annular air groove 44 and the perimeter 43 of the spray disk 40. As the nozzle 30 is threadedly engaged into the nozzle mounting bore 63, an O-ring 65 located in the O-ring groove 64 contacts and compresses against the nozzle mounting surface 32. As the O-ring 65 compresses into sealing contact with the rearward surface 42 and the nozzle mounting surface 32, the rear surface 42 of the spray disk 40 contacts the nozzle mounting surface 32 of the distribution plate 26. The relatively large area of contact between those two surfaces 42, 32 helps prevent the nozzle 40 from being over tightened. The O-ring 65 prevents the pressurized air from escaping the air chamber 57, flowing between the rear surface 42 and nozzle mounting surface 32 and leaking to atmosphere. The nozzle contains peripheral notches 66 which engage pins on a tool, for example, a spanner wrench, that is used to screw the nozzle into the nozzle mounting bore 63.

Figure 4:
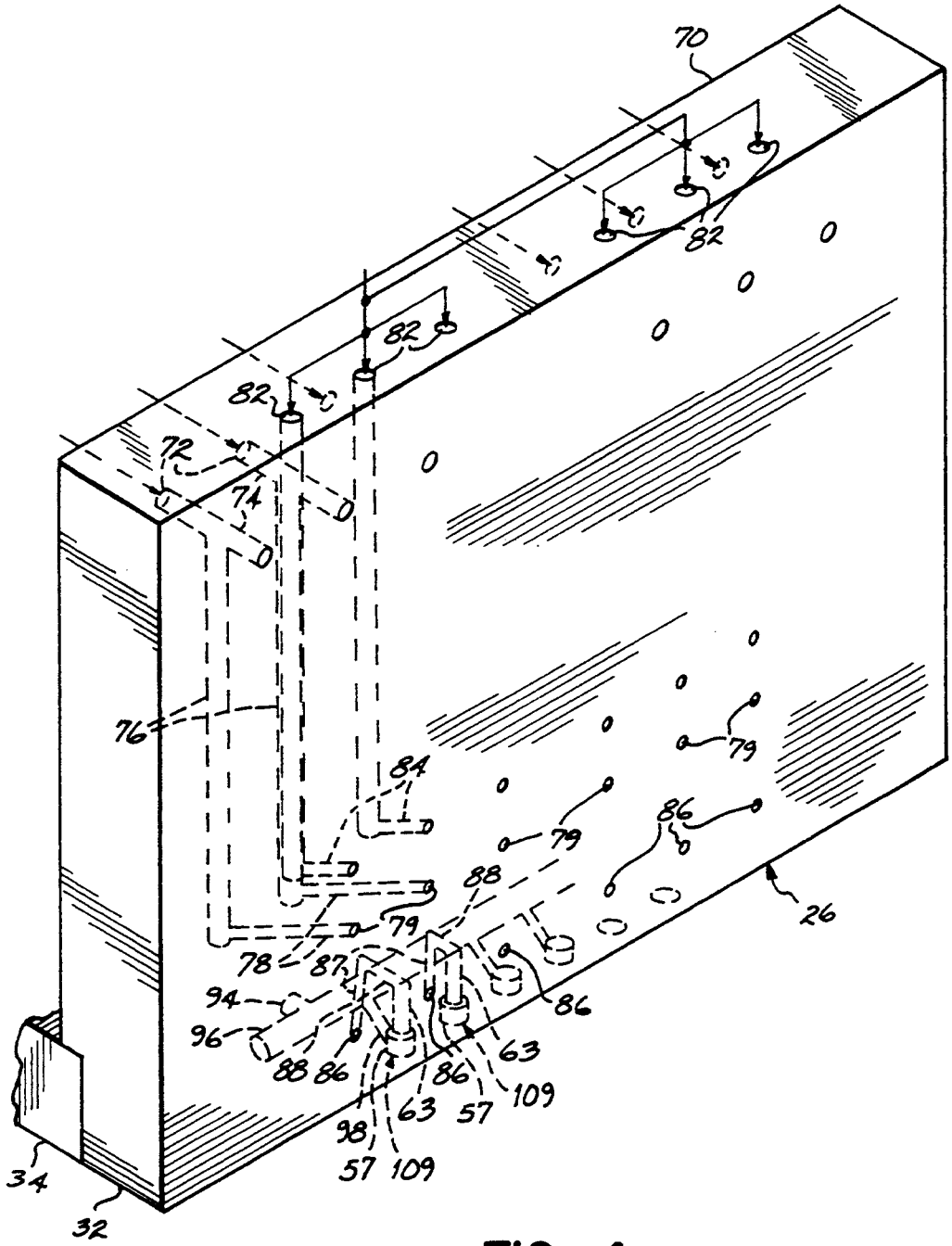
FIG. 4 is a perspective view of the distribution plate illustrating the adhesive passages and air passageways associated with a nozzle.

In order to mount the nozzles 30 directly to the nozzle mounting surface 32 of distribution plate 26, the distribution plate must contain air passageways and adhesive passages that terminate on the nozzle mounting surface 32 so that they communicate with the adhesive through bore and air jet bores of the nozzle 30. Referring to FIGS. 2 and 4, the rear side 70 of distribution plate 26 is connected to the central manifold 24 such that the central manifold provides a metered supply of heated hot melt adhesive to an adhesive input port 72. The heated hot melt adhesive passes through a cross passage 74 and then moves at right angles through the distribution plate 26 through a second passage 76. At the end of the second passage 76, the heated hot melt adhesive moves transversely through an oblique passage 78 out of the distribution plate 26 at exit port 79 and into a two way valve 28. The rear side 70 of the distribution plate 26 is also connected to the air manifold 34. The control air is supplied to a control air input port 82 which connects to a control air passage 84 communicating with two way valve 28. Supplying pressurized air to the control air input port 82 is effective to open the two way valve 28 so that heated hot melt adhesive passes through the valve 28. By removing the supply of pressurized control air from the control air input port 82, the two way valve 28 is closed to cut off the supply of heated hot melt adhesive.

When the valve is opened, the heated hot melt adhesive flows through the valve and reenters the distribution plate 26 on its front side at the heated hot melt adhesive reentry port 86. A second plurality of oblique passage 87 carry the heated hot melt adhesive to a third plurality of cross passages 88 which intersect a respective plurality of nozzle mounting bores 63 which are contiguous with a respective plurality of cavities 109 thereby connecting the nozzle adhesive passage 52 with the source of heated hot melt adhesive in the passage 88. The nozzle adhesive passage 52 provides heated hot melt adhesive to the nozzle tip 46 thereby dispensing a bead of heated hot melt adhesive from the spray head 12.

The air manifold 34 supplies the pressurized pattern control air through an air passageway 94 into an air distribution channel 96 which functions as a source of pressurized air. A plurality of oblique air passageways 98 supply the pressurized control pattern air from the distribution channel 96 to the air a plurality of respective chambers 57 which form part of the cavities 109 in the nozzle mounting surface 32 of the distribution plate 26. The pressurized air in the air chamber 57 is ducted by air jet bores 50 to the periphery of the nozzle tip. The pressurized air jets from the air jet bores 50 are effective to rotate the bead of hot melt adhesive dispensed from the nozzle tip to create an elongated bead 100 in a spiral pattern.

Figure 5:
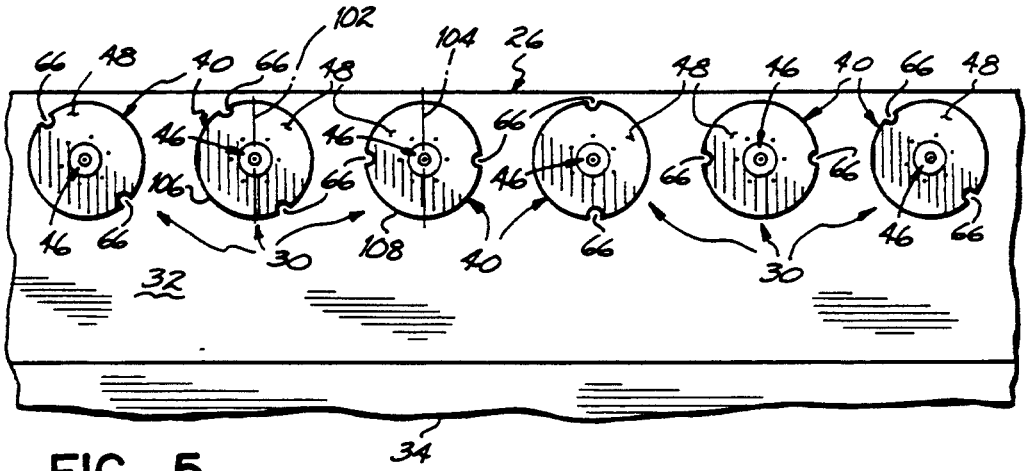
FIG. 5 is a bottom view of the distribution plate illustrating the minimum centerline spacing of nozzles of the present invention.

As illustrated in FIG. 5, the nozzles 30 are mounted directly over and cover the cavities 109 in the nozzle mounting surface 32 of distribution plate 26 without utilizing the threaded extension and nozzle mounting nut used on prior art spray heads. Therefore the distances between the centerlines 102 and 104 can be as small as 0.500 inches (12.7 mm) and can have a spacing in the range of 0.470 inches (11.94 mm) to 0.875 inches (22.23 mm). Centerline spacings in excess of that range are achievable with the prior nozzles which were mounted with mounting nuts on threaded extensions.

The nozzle of the present invention further permits the distance between the perimeters 106 and 108 of nozzles 30 to be 0.030 inches (0.762 mm) and in a range or from 0.005 inches (0.127 mm) to 0.030 inches (0.762 mm).

Figure 6:
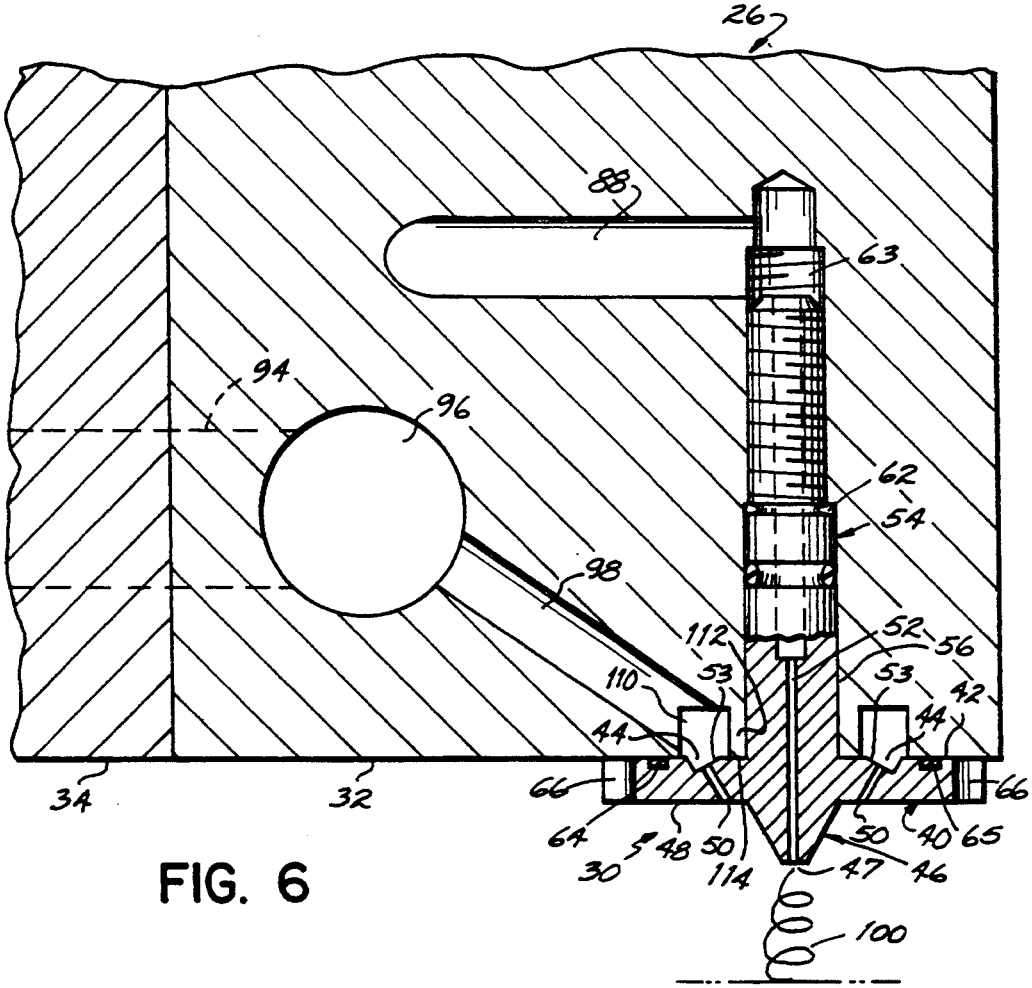
FIG. 6 is a cross-sectional view similar to that of FIG. 2 illustrating an alternative embodiment for routing the air passageway to the nozzle mounting surface.

In the embodiment of FIG. 2, the cavities 109 intersect the nozzle mounting surface; and each of the cavities 109 is comprised of the air chamber 57, sealing bore 62 and nozzle mounting bore 63 which is contiguous with a respective one of the plurality of cross passages 88. Consequently the cavity 109 is connected to both the supply of heated hot melt adhesive and the source of pressurized air. FIG. 6 is a cross-sectional view of an alternative embodiment of how the nozzle 30 can be mounted to the distribution plate 26. In this embodiment, pressurized air from the distribution channel 96 is supplied by oblique air passageway 98 to an annular air chamber 110 formed in and contiguous with the nozzle mounting surface 32. The annular air chamber 110 provides an annular wall 112 separating the annular air chamber 110 from the sealing bore 62. Therefore, when the nozzle 30 is threaded into the nozzle mounting bore 63 the rear surface 42 of the nozzle 30 has a metal-to-metal contact with the outer surface 114 of the annular wall 112. That contact provides an additional seal area between the hot melt adhesive in the adhesive passage 88 and the pressurized air in the air chamber 110, In addition, the metal-to-metal contact provides a centrally located mechanical support for the nozzle that helps prevent adverse effects from overtightening the nozzle into the distribution plate 26.

While the invention has been set forth by the description of the embodiments in considerable detail, it is not intended to restrict or in any way limit the claims to such detail. Additional advantages and modifications will readily appear to those who are skilled in the art. For example, the nozzle construction and its mounting on the distribution plate can be used with spray heads that do not meter the fluid into individual adhesive passages. Those spray heads simply direct the adhesive from the inlet 14, through the central manifold 24, through the distribution plate 26 and directly to the adhesive passages 52 associated with the nozzles. In addition, the nozzle construction of the present invention does not require the use of the two way valves for each of the adhesive passages but instead a single valve can be used to control adhesive flow collectively through all the nozzles.

The peripheral notches 66 on the spray disk may be replaced by holes located inside the periphery of the spray disk. The circular shape of the spray disk or spray plate on the nozzles can the replaced by a spray plate having a hexagonal shape. Therefore the nozzle is installed using standard wrenches, and the peripheral notches are not required. The spray plate could also have any other desired geometric shape. Further the nozzle could be mounted to the nozzle mounting surface with separate screws or other fasteners in lieu of the threaded portion of the shaft. Alternatively, the shaft and nozzle mounting bore could have mating tapered shapes that interface to provide the forces necessary to hold the nozzle in the distribution plate. Alternatively, the shaft of the nozzle may be press fit into the nozzle mounting bore in the distribution plate. Further, the exact arrangement of adhesive passages and air passageways through the distribution plate to the nozzle mounting surface may be varied to accommodate particular applications.

The invention, in its broadest aspects, is therefore not limited to the specific details shown and described. Accordingly, departures may be made from such details without parting from the spirit or scope of the invention.

What is claimed is:

1. A spray head connected to a supply of hot melt adhesive and source of pressurized air for dispensing a heated hot melt adhesive in a predetermined pattern of elongated strands comprising:

a distribution plate having a plurality of adhesive passages adapted to be in fluid communication with the supply of hot melt adhesive, a plurality of air passageways adapted to be in fluid communication with the source of pressurized air;

a flat planar nozzle mounting surface with a plurality of nozzle receiving locations, the nozzle mounting surface intersecting one of the plurality of adhesive passages and one of the plurality of air passageways at each of the plurality of nozzle receiving locations, a plurality of nozzles, each of the plurality of nozzles having a spray plate with an adhesive passage extending through said spray plate to an adhesive orifice, the spray plate having a plurality of air bores surrounding the adhesive orifice, and the spray plate further having a rear surface, each of said plurality of nozzles including a coupling means extending from the rear surface of a respective one of the plurality of nozzles for mounting the respective one of the plurality of nozzles to the nozzle mounting surface at a respective one of the nozzle mounting locations thereby bringing the adhesive orifice of the respective one of the plurality of nozzles in fluid communication with one of the adhesive passages and said plurality of air bores of the respective one of the plurality of nozzles in fluid communication with one of the air passageways.

2. The spray head of claim 1 wherein said plurality of nozzles have a corresponding plurality of centrally located longitudinal axes, and said plurality of nozzles are mounted on said nozzle mounting surface such that said centrally located longitudinal axes of said nozzles are separated by a distance ranging approximately from 0.470 inches (11.94 mm) to 0.75 inches (19.05 mm).

3. The spray head of claim 1 wherein said nozzles are mounted on said nozzle mounting surface of said distribution plate such that peripheral edges of said spray plates are separated by a distance ranging approximately from 0.005 inches (0.127 mm) to 0.30 inches (7.62 mm).

4. The spray head of claim 1 wherein said plurality of nozzles are mounted on said nozzle mounting surface such that said adhesive orifice of said spray plate of each of said plurality of nozzles is adapted to be closer to the surface of the substrate than any other part of each of said plurality of nozzles and said distribution plate.

5. The spray head of claim 1 wherein each of said plurality of nozzles further comprises sealing means encompassing said plurality of air bores and located between and in sealing contact with said rear surface of said spray plate and said nozzle mounting surface for preventing the pressurized air from leaking from between said rear side of said spray plate and said nozzle mounting surface to atmosphere.

6. The spray head of claim 1 wherein the distribution plate further comprising a bore intersecting the nozzle mounting surface at each of the nozzle mounting locations and wherein further each of the plurality the coupling means of said plurality of nozzles further comprises a shaft extending from said rear surface of said spray plate and into the bore for securing said nozzles to said nozzle mounting surface.

7. The spray head of claim 6 wherein the bore at each of the nozzle mounting locations includes a threaded section and wherein further the shaft each of said plurality of coupling means of said plurality of nozzles further includes threads for engaging the threaded section of a respective bore to secure a respective nozzle to the spray head.

8. The spray head of claim 7 wherein said distribution plate further includes a sealing bore extending inwardly from said nozzle mounting surface to said threaded bore and each of said coupling means further includes a second sealing member located between said shaft and said sealing bore for sealing the hot melt adhesive from the pressurized air.

9. A spray head connected to a supply of hot melt adhesive and a source of pressurized air for dispensing the hot melt adhesive in a predetermined pattern of elongated strands comprising:

a distribution plate having an adhesive passage adapted to be in fluid communication with said supply of hot melt adhesive, an air passageway adapted to be in fluid communication with said source of pressurized air;

a flat planar nozzle mounting surface having a a plurality of nozzle receiving cavities, each of said plurality of cavities connected to both said adhesive passage and said air passageway;

a plurality of nozzles, each of said plurality of nozzles mounted to said flat planar surface of said distribution plate and covering one of said plurality of nozzle receiving cavities; and a plurality of sealing members, each of said plurality of sealing members being located between and in sealing contact with one of said plurality of nozzles and a surface of a respective one of said plurality of cavities for sealing said adhesive passage from said air passageway.

10. An adhesive dispensing nozzle adapted for use with a spray head connected to a supply of hot melt adhesive and a source of pressurized air for dispensing a hot malt elongated adhesive fiber in a spiral pattern onto a substrate, the spray head having a nozzle mounting surface intersecting both an adhesive passageway in fluid communication with the supply of hot melt adhesive for conveying the hot melt adhesive and an air delivery passageway in fluid communication with the source of pressurized air for conveying the pressurized air, the adhesive dispensing nozzle comprising:

a spray plate having a front surface on one side of said spray plate and a rear surface on an opposite side of said spray plate;

a nozzle tip located on said front surface and extending outwardly therefrom;

a shaft located on with said rear surface and extending outwardly therefrom, the shaft having one end integral with the spray plate, threads on an opposite end of the shaft adapted to couple the spray plate to the nozzle mounting surface, a first annular seal receiving groove disposed in the shaft between the threads and the rear side of the spray plate, and a first O-ring seal located in said first annular seal receiving groove and adapted to be in sealing contact with the adhesive passageway to separate the heated hot melt adhesive from the pressurized air;

an adhesive passage extending through said shaft, said spray plate and said nozzle tip;

a plurality of bores extending through said spray plate from said opposite side of said spray plate to said front surface for transmitting therethrough;

a second annular seal receiving groove disposed in the rear side of the spray plate and encompassing the plurality of air bores; and a second O-ring seal located in and in sealing contact with said second annular seal receiving groove, said second O-ring seal adapted to be in sealing contact with the nozzle mounting surface to prevent pressurized air from escaping from between said rear surface and the nozzle mounting surface.

11. The adhesive dispensing nozzle of claim 10 wherein said spray plate has a circular shape.

12. The adhesive dispensing nozzle of claim 10 wherein said nozzle tip and said shaft are centrally located with respect to said spray plate and said adhesive passage extends centrally through said shaft.

13. The adhesive dispensing nozzle of claim 10 further comprising a substantially V-shaped annular groove forming first and second sidewalls, each sidewall extending inwardly from said rear surface toward said front surface and intersecting one another, and each of said plurality of bores having a longitudinal axis extending substantially perpendicular to one of said first and second sidewalls of said annular groove, said bores intersecting said one of said side walls and being formed at an angle with respect to said adhesive passage.

14. An adhesive dispensing nozzle adapted for use on a spray head connected to a supply of hot melt adhesive and a source of pressurized air for dispensing a hot melt adhesive in a predetermined pattern of elongated strands, the spray head having a nozzle mounting surface, the adhesive dispensing nozzle comprising:

a spray plate having a front side and an opposite rear side;

a nozzle tip disposed on the front side of the spray plate;

a plurality of air bores surrounding the nozzle tip and extending through the spray plate to intersect the front and rear sides of the spray plate;

a shaft extending outwardly from the rear side of the spray plate, the shaft having one end joined with the spray plate, threads on an opposite end adapted to couple the spray plate to the nozzle mounting surface, and a first annular sealing area disposed on the shaft between the threads and the rear side of the spray plate and adapted to be in sealing contact with the spray head;

an adhesive passage extending through the nozzle tip, through the spray plate and through the shaft; and the rear side of the spray plate having a second annular sealing area encompassing the plurality of air bores and adapted to be in sealing contact the nozzle mounting surface.

15. An adhesive dispensing nozzle adapted for use on a spray head connected to a supply of hot melt adhesive and a source of pressurized air for dispensing a hot melt adhesive in a predetermined pattern of elongated strands, the nozzle comprising:

a spray plate having a front side and an opposite rear side;

a nozzle tip disposed on the front side of the spray plate;

a plurality of air bores surrounding the nozzle tip and extending through the spray plate to intersect the front and rear sides of the spray plate;

a shaft extending outwardly from the rear side of the spray plate, the shaft having one end joined with the spray plate, threads on an opposite end adapted to couple the spray plate to the nozzle mounting surface, and a first annular seal receiving groove disposed in the shaft between the threads and the rear side of the spray plate and adapted to receive a seal in sealing contact with the spray head;

an adhesive passage extending through the nozzle tip, through the spray plate and through the shaft; and a second annular seal receiving groove disposed in the rear side of the spray plate and encompassing the plurality of air bores and adapted to receive a seal in sealing contact with the nozzle mounting surface.

16. An adhesive dispensing nozzle adapted for use on a spray head connected to a supply of hot melt adhesive and a source of pressurized air for dispensing a hot melt adhesive in a predetermined pattern of elongated strands, the spray head having a nozzle mounting surface, the nozzle comprising:

a spray plate having a front side and an opposite rear side;

a nozzle tip disposed on the front side of the spray plate;

a plurality of air bores surrounding the nozzle tip and extending through the spray plate to intersect the front and rear sides of the spray plate;

a shaft extending outwardly from the rear side of the spray plate, the shaft having one end joined with the spray plate, threads on an opposite end adapted to couple the spray plate to the nozzle mounting surface, and a first annular seal mounted on the shaft between the threads and the rear side of the spray plate and adapted to be in sealing contact with the spray head;

an adhesive passage extending through the nozzle tip, through the spray plate and through the shaft; and a second annular seal mounted on the rear side of the spray plate and encompassing the plurality of air bores and adapted to be in sealing contact with the nozzle mounting surface.

17. The adhesive dispensing nozzle of claim 16 wherein said shaft is a unitary integral Dart of said spray plate.

* * * * *

UNITED STATES PATENT AND TRADEMARK OFFICE

CERTIFICATE OF CORRECTION

PATENT NO. : 5,368,233

DATED : November 29, 1994

INVENTOR(S) : Paul Brusko

It is certified that error appears in the above-indentified patent and that said Letters Patent is hereby corrected as shown below:

Col. 3, line 23, after "piece", insert -- of --.

Col. 7, line 31, "are" should be -- one --.

Col. 7, line 31, after "end", insert -- integral --.

Col. 7, line 31, after "shaft 54", delete -- integral --.

Col. 7, line 41, after "58", insert -- is --.

Col. 7, line 52, after "groove", insert -- 64 --.

Col. 8, line 34, "passage" should be -- passages --.

Col. 9, line 3, "range or" should be -- range of --.

Col. 9, line 52, "can the" should be -- can be --.

Col. 10, line 8, after "and", insert -- a --.

Col. 11, line 11, after "shaft", insert -- of --.

Col. 11, line 50, "malt" should be -- melt --.

UNITED STATES PATENT AND TRADEMARK OFFICE

CERTIFICATE OF CORRECTION

PATENT NO. : 5,368,233

DATED : November 29, 1994

INVENTOR(S) : Paul Brusko

It is certified that error appears in the above-indentified patent and that said Letters Patent is hereby corrected as shown below:

Col. 12, line 13, after "transmitting", insert -- air --.

Col. 14, line 29, "Dart" should be -- part --.

Signed and Sealed this

Thirty-first Day of October 1995

*Attest:*

Bruce Lehman

BRUCE LEHMAN

*Attesting Officer*

*Commissioner of Patents and Trademarks*